United States Patent [19]

Duden

[11] 3,941,246

[45] Mar. 2, 1976

[54] PACKAGE FOR RADIOGRAPHIC FILMS

[75] Inventor: Emanuel Hubert Duden, Mortsel, Belgium

[73] Assignee: AGFA-GEVAERT N.V., Mortsel, Belgium

[22] Filed: Apr. 19, 1974

[21] Appl. No.: 462,544

[30] Foreign Application Priority Data

Oct. 23, 1973 Belgium ..... 5448

[52] U.S. Cl. ..... 206/455; 206/498; 206/820; 229/69

[51] Int. Cl.[2] ..... B65D 27/10; B65D 85/00

[58] Field of Search ..... 40/10 D; 206/455, 456, 206/498, 820, 390; 229/69, 56; 150/38

[56] References Cited

UNITED STATES PATENTS

| | | | |
|---|---|---|---|
| 1,536,341 | 5/1925 | Hodgson | 206/455 X |
| 2,281,237 | 4/1942 | Eckman | 206/390 UX |
| 2,288,386 | 6/1942 | Belden | 132/73 |
| 2,495,734 | 1/1950 | Katzman et al. | 206/820 X |
| 2,976,989 | 3/1961 | Wiesner | 206/455 |
| 3,162,539 | 12/1964 | Repko | 206/820 X |
| 3,443,093 | 5/1969 | Lindenmuth et al. | 206/455 X |

FOREIGN PATENTS OR APPLICATIONS

| | | | |
|---|---|---|---|
| 520,338 | 6/1953 | Belgium | 206/820 |
| 1,122,371 | 1/1962 | Germany | 206/455 |

*Primary Examiner*—William Price
*Assistant Examiner*—Steven E. Lipman
*Attorney, Agent, or Firm*—William J. Daniel

[57] ABSTRACT

A belt-forming package, intended for use in packaging radiographic dental films is presented. The package is characterized in that the film materials are separately packed in such a way that taking one film packet out of the belt is facilitated by the provision of zones of less mechanical strength at the circumference of each separate packet. Opening of the separate packets puts no problems as a lip-like portion having an asymmetric wave-type form is overlappingly sealed to another portion so that the rupturing of the seal between both portions, causing the opening of the concerning separate packet is facilitated.

9 Claims, 8 Drawing Figures

10
13
11
12
14
15

28
23
20
26
5
24
5
25
10

29
23
20
29
29
29
23
23

22
25
10
31

PACKAGE FOR RADIOGRAPHIC FILMS

The present invention relates to a package for unexposed X-ray sensitive film sheets and to a method of packaging such film sheets. More particularly, the invention relates to a new type of package for materials remaining in their wrapper during the X-ray exposure of such materials. This type of materials comprise a.o. non screen medical X-ray films, X-ray films used for non destructive testing of materials films used for X-ray dosimetry and X-ray films used in dentistry. By way of example, only the last mentioned type of X-ray films will be considered in the following description.

Films used for dental examination consists of one or two small-sized sheets of X-ray sensitive material, occassionally provided at either side with a paper/lead laminate whereupon the so formed sandwich is enclosed in a light-tight and moisture impervious wrapper, thereby to create a separate small-sized packet. Preferably a number of such packets are enclosed in a belt forming package which may be brought into a dispenser. In this way dispensing of the separate packets can be done in an easy manner.

The present invention aims at optimizing such belt forming package and to render the dispensing of the separate packets more convenient.

A further object of the invention is to provide a novel method for the continuous packaging of such separate small-sized packets.

The invention comprises a belt-forming package for the light-tight and moisture-impervious packaging of separate sheet materials wherein these separate sheet materials are contained between two webs of soft thermoplastic material sealed to each other over the circumferential surface of said sheet materials while tightly surrounding same so as to form separate packets enclosed in the belt, wherein said packets show a lower mechanical strength at the circumferential zones and one of said belt constituting webs of soft thermoplastic material consists of two composing strips duly sealed to each other in overlapping relationship.

According to the invention, the method for packaging separate sheet materials comprises the following steps:

- producing separate pockets by sealing two webs of soft thermoplastic material, one of them consisting of two composing webs previously sealed together length-wise, twice in transverse direction and once in longitudinal direction at one side of said webs,
- maintaining these pockets in opened position by applying appropriate means for introducing the sheet material length-wise at the second side into these pockets;
- sealing the filled pockets length-wise over said other side so as to form separate packets, and
- providing the circumferential surface of each separate packet with areas of lower mechanical strength.

The embodiments of a belt forming package, the separate packets and the packaging method as well are described more in detail with reference to the accompanying drawings in which.

Figure 6B:
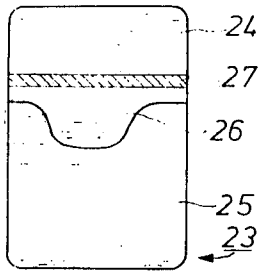
Figure 6A:
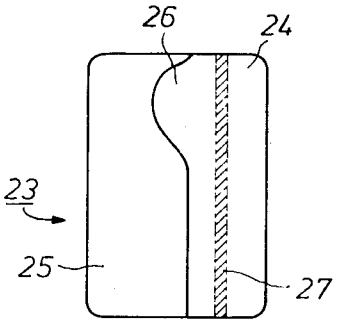

FIGS. 6*a* and 6*b* are illustrations of separate packets, and

Figure 7:
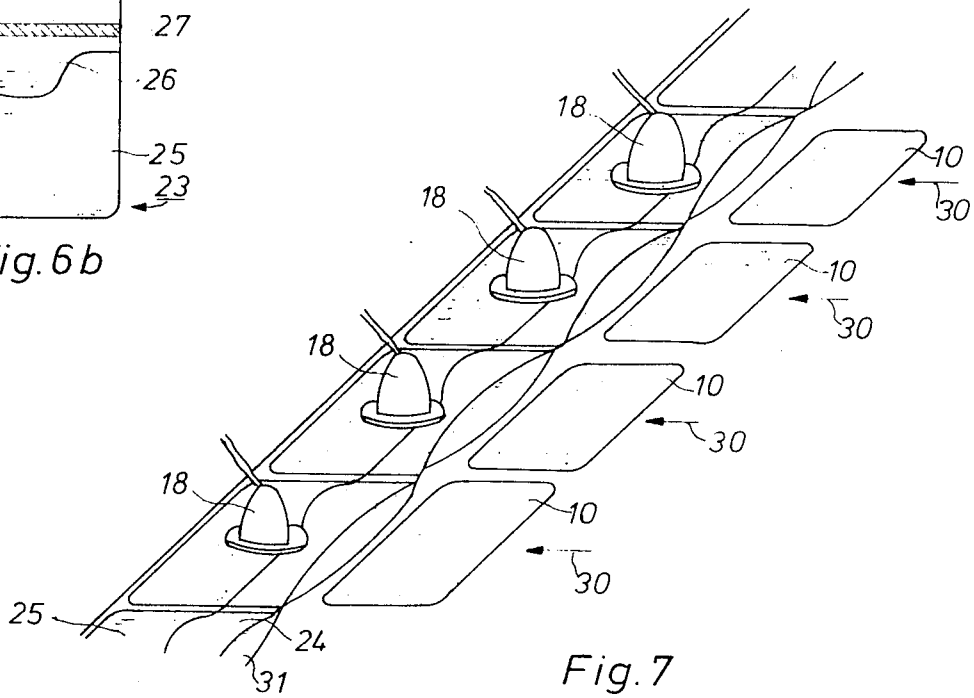

FIG. 7 shows the elementary way for packaging the film sheets packets to create the belt forming package.

Figures 1, 2, 3, 4:
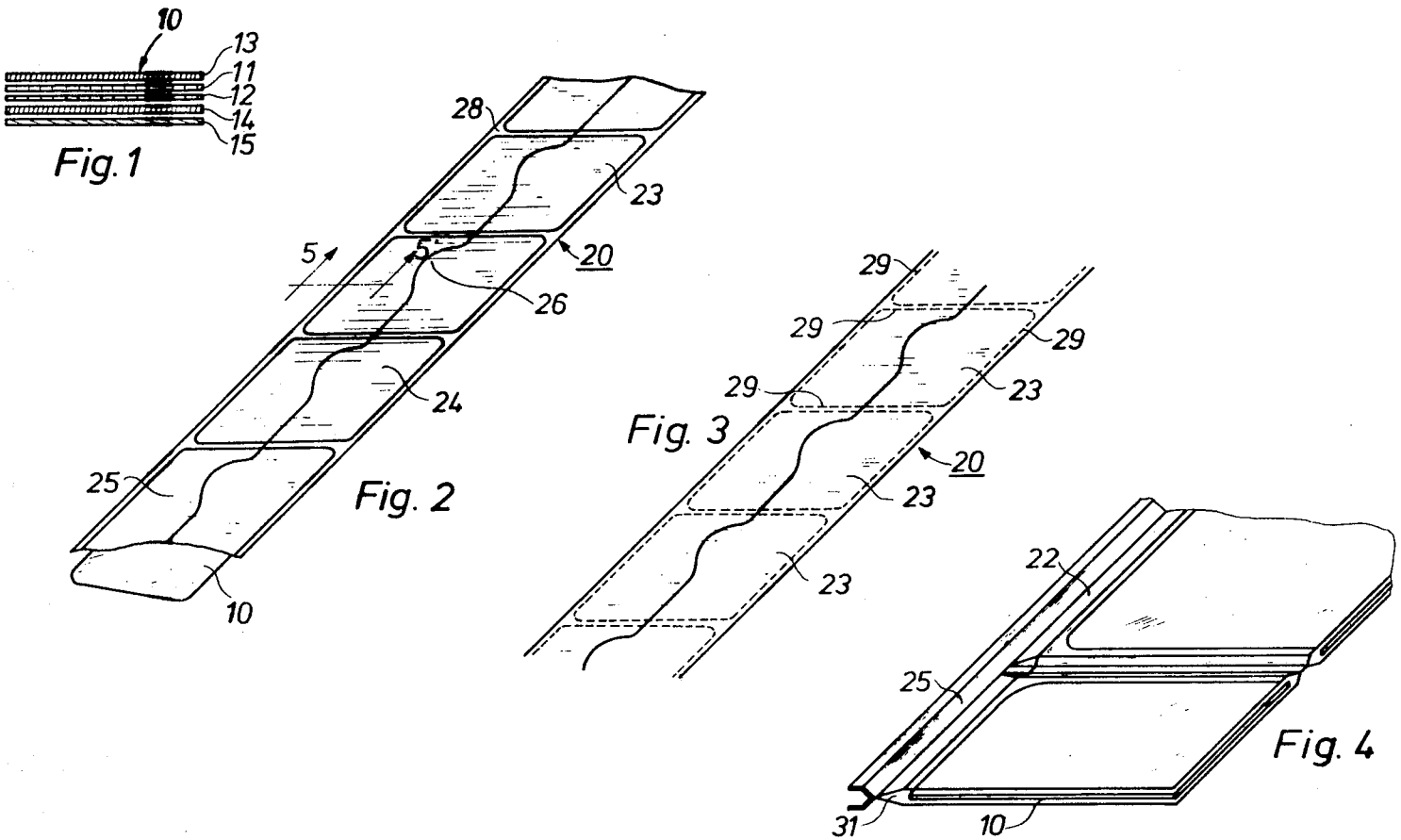
FIG. 1 is a sectional view of a film sheet containing packet.
FIG. 2 is a view of a belt forming package containing separately packed films.
FIGS. 3 and 4 are modified types of the package according to FIG. 2.

The packet of unexposed films 10 as shown in FIG. 1 in inaccurate proportions generally comprises two film sheets 11 and 12 contained between paper sheets 13 and 14. Occasionally, a lead foil 15 is provided for absorbing the irradiation as much as possible after exposure to X-rays of the object to be examined. For other applications such as radiodosimetry and the non-destructive testing of objects a light-tight and moisture-impervious package containing one or two films without the mentioned auxiliary materials may suffice.

As shown in FIG. 2 the unexposed films 10 and their occasional auxiliary materials are packaged to form a belt forming package 20. The package belt 20 contains a great number of separate packets 23 which can be taken from the package belt 20 in an easy and simple way by rupturing the zones 28 of less mechanical strength provided at the circumferential surface of the packets 23. As can further be seen in FIG. 2, the upper web composing the belt consists of two parts so that the separate packets comprise an upper part 24 and a lower part 25 sealed to each other, the upper part 24 having an asymmetric lip portion 26.

FIG. 3 illustrates an analogous method of packaging films. The package belt 20 is composed of a plurality of separate packets 23 but the zones of less mechanical strength are situated in the form of perforations 29 made in the circumferential edge of each packet.

FIG. 4 shows a detail of a way of packaging films wherein the zones of less mechanical strength are formed as a portion of reduced thickness 22 at the welding area. Such portion of reduced thickness 22 can advantageously be applied by practising relatively high pressures during the welding step when the belt composing webs 25 and 31 are in a soft state thereby greatly improving their deformability.

Figure 5:
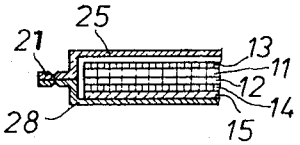
FIG. 5 is a sectional view of the belt forming package on line 5–5′ of FIG. 2.

Another way of providing zones of less mechanical strength at the edge of a separate packet is shown in FIG. 5 which is a sectional view of the package on the line 5–5′ of FIG. 2. In this type of package said zones of less mechanical strength are formed as an incision 21 in the front part 25 of the package belt. The incision 21 can be made with a knife during the welding step.

FIGS. 6*a* and 6*b* illustrate a packet 23 after its removal from the package belt. This packet has the advantage of easy and simple handling for its opening after removal from the package belt. To this end two webs i.e. a non-deformed web 25 and a wave profiled web 24 are light-tightly and slightly welded to each other along the line 27. Preferably, this step is previously executed on a so-called roller type seam welder for thermoplastic materials operating with ultrasonic and ultrahigh frequencies as well.

This wave profile of the web 24 is obtained by carrying a web by means of a rotating knife with a corresponding profile in combination with a pressure roller. Preferably, the wave profiled web 24 is positioned so that the downwardly waved portion 26 forming a kind of lip is situated at one side of the finished package, whereby the opening of the packet, after its exposure, by rupturing the portion of less mechanical strength is much simplified. Although in FIG. 6*a* and the foregoing figures, the longer side of the package is illustrated as lying in the longitudinal direction of the belt, said embodiment is, however, not a limiting one and the packet may be provided as well with its longer side situated transversely with respect to the longitudinal direction of belt, as is illustrated in FIG. 6*b*.

In FIG. 7 the method is illustrated for packaging packets with unexposed films to form a package belt. A web 31 and a combined web composed of the webs 24 and 25, preferably consisting of a smooth deformable thermoplastic material, such as polyvinyl chloride, are partly welded together by means of ultrasonic or ultrahigh frequent energy to form small pockets in which the packets containing unexposed films 10 can be introduced according to the direction indicated by the arrow 30. To this end, the pockets are partly kept open by means of vacuum suction cups 18 for facilitating the introduction of the packets containing the films 10. This introduction can be done either by hand or by machine operation. As soon as the packets are located in their respective pockets, the opening is close-welded whereby a belt forming package 20 is obtained housing the packets as represented in FIG. 2. This type of package is very handy in use as each packet 23 can be taken out of the belt in a very simple and easy way.

The opening of the package is done as follows: the operator takes the packet by seizing the bottom part thereof with his left hand thumb and forefinger and the wave profiled portion 26 with his right hand thumb and forefinger. By pulling the portion 26 upwardly, the welded seam 27 between the webs 24 and 25 is torn loose and also the edge of weaker constructed strength than the belt will be removed, so that finally the belt portion 24 has fully been torn off. Thereupon the packet of film(s) and occasional auxiliary materials can be taken out of the package very simply and be treated in a further station.

Films packed in a belt forming package may be located e.g. in sets of a few tenths of them, situated in staggered position or in roll form, into a dispensing apparatus.

We claim:

1. A continuous belt package for a multiplicity of sheet-like materials from which the sheet-like materials can be removed one by one without disrupting the belt continuity, comprising a continuous supporting web of a width somewhat exceeding the material width, a top web constituted of two continuous strips arranged in overlapping relation along their mutually inner edges and having an overall width generally equal to said supporting web, a multiplicity of said materials disposed in lengthwise spaced relation between said webs, the margins of said webs around the periphery of the individual materials being sealed together, at least one of said webs having a zone of weakness around the material periphery to permit the same to be separated from the remainder of the belt package for removal of the individual materials therefrom.

2. The belt package of claim 1 wherein the inner edge of the uppermost of said overlapping strips has a generally wave-form configuration.

3. The belt package of claim 2 wherein said wave-form edge of the uppermost strip defines inwardly-projecting tongues located in spaced relation corresponding to said materials.

4. Package according to claim 2, wherein said wave-form edge has an asymmetric wave-type form.

5. Package according to claim 1, wherein the zones of weakness is formed as front part incision.

6. Package according to claim 1, wherein said zones of weakness is a reduced thickness which is smaller than the total thickness of the composing webs.

7. Package according to claim 6, wherein said zones of weakness is obtained by the application of pressure during the sealing of both webs together.

8. Package according to claim 1, wherein said zones of less mechanical strength are defined by a line of perforations.

9. Package according to claim 1, wherein the material used for the production of the webs is polyvinyl chloride.

* * * * *

UNITED STATES PATENT AND TRADEMARK OFFICE

CERTIFICATE OF CORRECTION

PATENT NO. : 3,941,246

DATED : March 2, 1976

INVENTOR(S) : Emanuel Hubert Duden

It is certified that error appears in the above-identified patent and that said Letters Patent are hereby corrected as shown below:

In the Claims:

Column 4, claim 5, line 1, "zones" should read -- zone --;

claim 6, line 1, "zones" should read -- zone --;

line 2, "is" should read -- has --;

claim 7, line 1, "zones" should read -- zone --;

claim 8, line 1, "zones" should read -- zone --;

line 2, "less mechanical strength are"

should read -- weakness is --.

Signed and Sealed this

*fourth* Day of *May 1976*

[SEAL]

*Attest:*

RUTH C. MASON
*Attesting Officer*

C. MARSHALL DANN
*Commissioner of Patents and Trademarks*